US008175308B2

(12) United States Patent
Olsen et al.

(10) Patent No.: US 8,175,308 B2
(45) Date of Patent: May 8, 2012

(54) EARPLUG FOR A HEARING AID

(75) Inventors: Jorgen Mejner Olsen, Hillerod (DK); Christian Bohl Espersen, Ballerup (DK)

(73) Assignee: Widex A/S, Lynge (DK)

( * ) Notice: Subject to any disclaimer, the term of this patent is extended or adjusted under 35 U.S.C. 154(b) by 1247 days.

(21) Appl. No.: 11/852,038

(22) Filed: Sep. 7, 2007

(65) Prior Publication Data

US 2008/0013767 A1 Jan. 17, 2008

Related U.S. Application Data

(63) Continuation-in-part of application No. PCT/DK2005/000165, filed on Mar. 10, 2005.

(51) Int. Cl.
*H04R 25/00* (2006.01)
*H04R 25/02* (2006.01)

(52) U.S. Cl. ..... 381/328; 181/130

(58) Field of Classification Search ..... 381/312, 381/322, 328, 330, 325, 380; 181/129, 130, 181/135
See application file for complete search history.

(56) References Cited

U.S. PATENT DOCUMENTS

| | | | | |
|---|---|---|---|---|
| 3,934,100 | A * | 1/1976 | Harada | 181/135 |
| 5,616,891 | A | 4/1997 | Fumey | |
| 7,027,608 | B2 * | 4/2006 | Fretz et al. | 381/330 |
| 2002/0172386 | A1 | 11/2002 | Bayer | |
| 2002/0181728 | A1 | 12/2002 | Connors | |

FOREIGN PATENT DOCUMENTS

| | | | |
|---|---|---|---|
| DE | 3917804 | A1 | 6/1990 |
| JP | 55-68890 | | 5/1980 |
| JP | 3-66284 | | 6/1991 |
| JP | 07131898 | A * | 5/1995 |
| JP | 08-037697 | | 2/1996 |
| JP | 2000-201388 | | 7/2000 |
| WO | 99/04601 | A1 | 1/1999 |

OTHER PUBLICATIONS

English Translation of JP Office Action 2008-500046 dated Oct. 19, 2010.

Patent Abstracts of Japan, vol. 1995, No. 8, Sep. 29, 1995 corresponding to P 07 131898 dated May 19, 1995.

"GN Resound design No. 000007893-0001" RCD-Online, 'Online! Jul. 8, 2003, XP002352145.

* cited by examiner

*Primary Examiner* — Curtis Kuntz
*Assistant Examiner* — Sunita Joshi
(74) *Attorney, Agent, or Firm* — Sughrue Mion, PLLC

(57) ABSTRACT

An earplug (7) for a hearing aid (1), in particular for a BTE-type hearing aid, has a front end (8) and a rear end (9). The front end (8) is adapted to be inserted into an ear canal of a wearer. The earplug (7) comprises a main body part (10) comprising a longitudinal bore (11) extending along a centrally arranged axis (A-A) of the earplug (7), and at least one sound output passage (17) in communication with said longitudinal bore (11) and leading to a sound output opening (18). The earplug also has a collar (19), which is adapted to engage the wall of an ear canal and surrounds the main body part (10). The output opening (18) has at least one edge part (18*a*) located in a retracted manner with respect to said front end (8).

19 Claims, 10 Drawing Sheets

EARPLUG FOR A HEARING AID

RELATED APPLICATIONS

The present application is a continuation-in-part of application No. PCT/DK2005/000165, filed on Mar. 10, 2005, in Denmark and published as WO2006/094502 A1.

BACKGROUND OF THE INVENTION

1. Field of the Invention

The present invention relates to hearing aids. The invention, more specifically relates to an earplug for a hearing aid and a hearing aid with an earplug, in particular a soft earplug for a BTE-type hearing aid.

2. The Prior Art

BTE-type hearing aids generally have a hearing aid housing comprising a hard shell in which all of the electronics, including input and output transducers, of the hearing aid are typically located. The hard shell is worn Behind The Ear, hence the abbreviation BTE. If the output transducer is located in the hearing aid housing, the output sound from the hearing aid is conducted via a sound tube to an earplug placed in an ear of the person wearing the hearing aid. Both the sound tube and the earplug constitute replaceable parts, which can be, and normally are, replaced with regular intervals. The earplug, which is in direct contact with the ear, is typically replaced more often than the sound tube, because it is more prone to be soiled, e.g. by cerumen.

Since the earplug is frequently replaced, it is not desirable to provide it as an individually fitted piece i.e. adapted to the specific shape of the ear canal of the wearer. Rather, it should be provided as a soft plug, which is comfortable to wear, by any person, irrespective of the specific shape of the ear canal. In practice however, even soft earplugs will not fit any person, but have to be provided in a few different lengths and diameters, e.g. two or three, in order to fit both children and adults.

Regarding comfort, it is also desirable to provide an earplug, which does not completely block the ear canal. Blocking the ear canal completely leads to the uncomfortable occlusion effect, where distorted sounds transmitted through bones and other tissue become more predominant.

One type of soft earplug is marketed by the company GN Resound, Taastrup, Denmark. This earplug could roughly be described as having a mushroom shape with a fourth order rotational symmetry along a center axis. The earplug comprises a central part comprising a longitudinal bore and one sound output opening in communication with said longitudinal bore, a collar surrounding said central part and adapted to engage the wall of an ear canal, and four sound passages communicating with the environment outside of the ear canal, the sound passages being provided between said collar and said central part. The sound output opening is located axially at the tip of the front end inserted into the ear canal, i.e. concentrically with the axis of the rotational symmetry. The earplug is made from silicone rubber, which is injection mounded and subsequently vulcanized.

EU design no. 000007893-0001, registered on 1 Apr. 2003, shows a hearing aid with an earpiece.

Designing an earplug with an axial opening at the tip, however, incurs a risk that on inserting it in the ear, cerumen may enter the sound output opening. If this happens, the sound produced by the hearing aid cannot leave the plug, thus adversely affecting the proper function of the hearing aid.

Providing a selection of standardized earplugs may not be sufficient to ensure, that each and every wearer can get a satisfactory fit. That is to say, the ear canal may for the specific user have such a shape that when the earplug is inserted into the ear canal, it always or mostly ends up in a position, in which the sound output opening is blocked by the wall of the ear canal.

The company Bruckhoff Apparatebau, Hannover, Del., supplies an attachment for the sound tube of hearing aids. This device is marketed under the name Cerumen Defenser (CD). This attachment cannot be considered to be an earplug, as it does not engage the ear canal. Instead it is held freely in the ear canal supported only by the sound tube. This device is generally cylindrical with a central bore. From the central bore, sound output openings extend axially away from the sound tube as well as transversely in the radial direction. This known device has been shown on the internet, <URL: http://www.bruckhoff-apparatebau.com/zub-allg.htm> 31 Jan. 2005.

Though not specifically for a hearing aid, a further earplug is known from U.S. Pat. No. 3,934,100. This earplug has a single sound output opening at the very tip of the earplug in the insertion direction.

SUMMARY OF THE INVENTION

From this prior art it is the object of the present invention to provide an earplug for a hearing aid, which is less prone than prior art earplugs to blocking, in particular blocking by the ear canal wall in the inserted position, but also by cerumen picked-up during insertion. In particular, but not exclusively, the object of the invention relates to a soft earplug adapted to be attached to the sound tube of a BTE-type hearing aid.

According to a first aspect of the present invention, there is provided an earplug earplug for a hearing aid, comprising a front end, a main body part and a collar, wherein said front end is adapted to be inserted into an ear canal of a wearer, wherein said main body part has a bore, a first sound output passage in communication with said bore and leading to a first sound output opening, said first sound output opening having at least one edge part located in a retracted manner with respect to said front end, and said first sound output passage having a taper towards the longitudinal bore, and said collar surrounds said main body part and is adapted to engage a wall of the ear canal.

According to a second aspect of the present invention, there is provided a hearing aid, comprising an earplug, said earplug having a front end, a main body part and a collar, wherein said front end is adapted to be inserted into an ear canal of a wearer, wherein said main body part has a bore, a first sound output passage in communication with said bore and leading to a first sound output opening, said first sound output opening having at least one edge part located in a retracted manner with respect to said front end, and said first sound output passage having a taper towards the longitudinal bore, and said collar surrounds said main body part and is adapted to engage a wall of the ear canal.

By arranging the edges of the sound output opening in this way it is achieved that the sound output openings and the sound passages leading to them are located in a lateral way, i.e. not facing forward in the insertion direction of the ear plug. By placing the sound output opening in this way, several factors cooperate to prevent blocking of the sound output openings. First of all, having the sound output opening arranged in this lateral way, reduces the risk that cerumen is pressed into the opening, during insertion of the earplug into the ear canal. Moreover, having the sound output opening in the main body part, and having a collar surrounding the main body part, reduces the risk of the sound opening engaging the wall of the ear canal, which would block the opening, or, if the engagement is only temporary during insertion of the earplug into the ear canal, could lead to cerumen being pressed into the sound output opening, thus blocking it. Thus the collar not only fulfils the primary function of holding the earplug in the ear canal, but also aids in keeping the sound output opening free from blockage.

According to a preferred embodiment, said main body part comprises at least one further sound passage. Having more than one sound passage, and hence more than one sound output opening drastically reduces the risk of a total blockage, in particular if the openings are arranged in such a way that they cannot all engage the wall of the ear canal at the same time.

This is in particular the case if, according to a further preferred embodiment, a plurality of sound passages each has at least one edge part located in a retracted manner with respect to said front end. In this case the sound output openings may be distributed around the main body part, preferably equidistant. Thus, if one opening should engage the wall of the ear canal because the earplug is badly centered, the other sound output openings would have an increased distance to the wall of the ear canal.

It is however also the case if, according to another preferred embodiment, said at least one further sound passage extends in a direction coaxially with an axis, preferably a centrally arranged axis.

According to another preferred embodiment said at least one sound passage has a circular cross section. A circular cross section is easy to provide in connection with the molding of the earplug. If the passage is frusto-conical, it facilitates removal of the cores of the mould.

According to a different preferred embodiment, the at least one sound passage comprises a slit. Providing the sound output openings in this manner may obviate the need for extra cores in the molding process of the earplug.

In a further preferred embodiment, the at least one sound passage has a taper towards the longitudinal bore. This allows wide openings with a cross section larger than the cross sectional dimensions of the longitudinal bore, which in turn not only reduces the risk of the sound output openings being blocked, but also facilitates the removal of cores after the molding process, as mentioned above.

According to another preferred embodiment, the longitudinal bore has means adapted for engaging a sound tube. This facilitates the assembly and mutual fixation of the earplug and the sound tube.

According to a further embodiment, at least a part of said longitudinal bore has a polygonal cross section, in particular a square cross section. This is advantageous in relation to the molding of the earplug, because it facilitates the molding of sound output openings perpendicular to the longitudinal axis of the hearing aid.

According to yet another preferred embodiment, at least one vent passage is provided in said collar. This not only prevents the occlusion effect, but also allows persons with mild hearing losses to hear environmental sounds directly.

BRIEF DESCRIPTION OF THE DRAWINGS

The invention will now be described in more detail in conjunction with several embodiments and the accompanying drawings, in which.

DETAILED DESCRIPTION OF THE INVENTION

Figure 1:
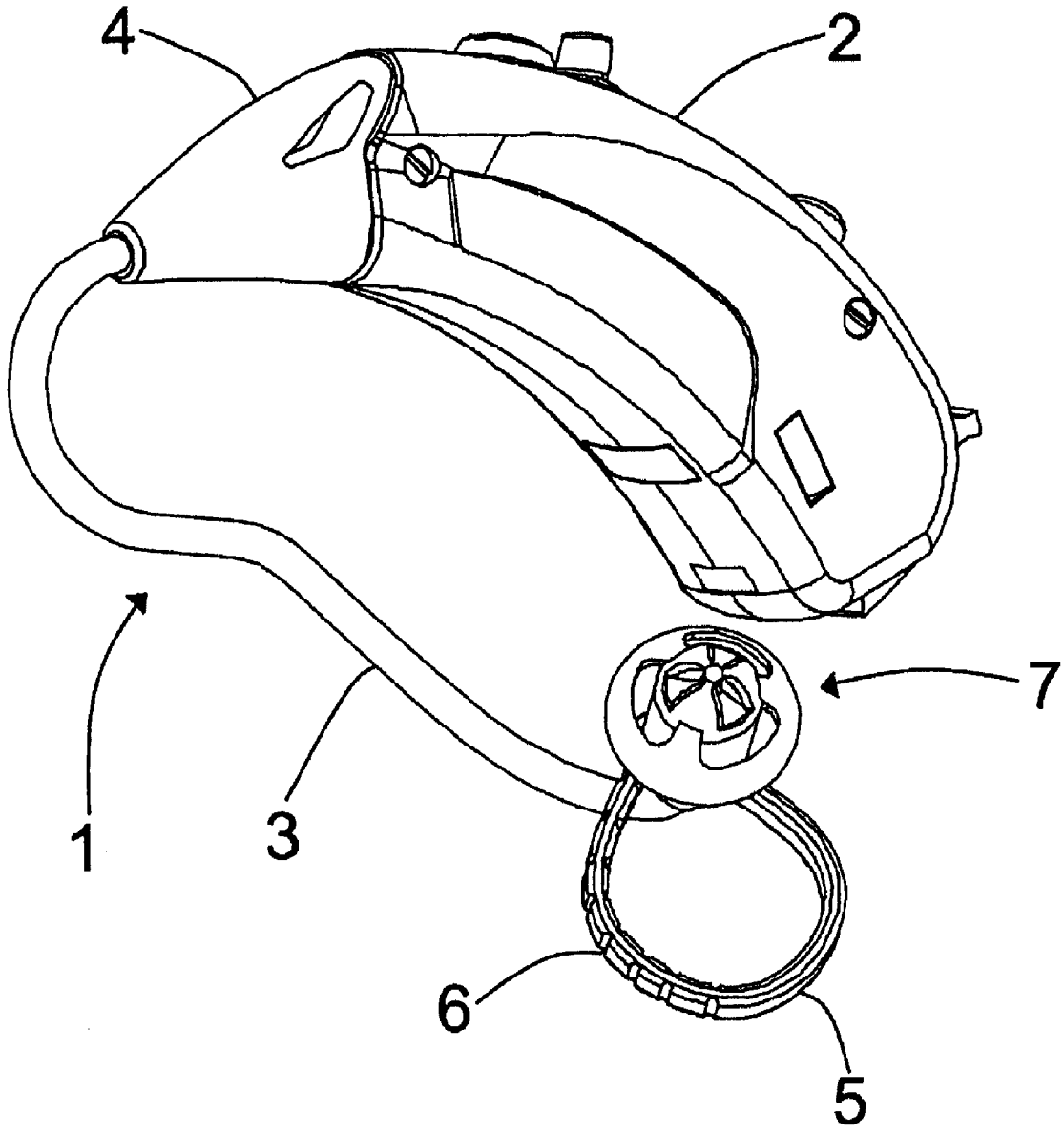
FIG. 1 is a perspective view of a BTE-type hearing aid mounted with a sound tube which is terminated in an earplug according to a first embodiment of the invention.

FIG. 1 shows a BTE-type hearing aid generally designated by reference numeral 1. The BTE-type hearing aid comprises a housing 2 containing the electronics of the hearing aid 1 including input and output transducers, signal processing means, etc. A sound tube 3 is attached to the housing 2. The sound tube 3 comprises at one end a coupling means 4 for attaching it to the housing 2 and coupling the sound tube to the output transducer of the hearing aid 1, located in the housing 2 of the hearing aid 1. At the other end of the sound tube 3 there is arranged a holding means in the form of a loop 5 to be placed inside of the outer ear behind the tragus but essentially outside the ear canal, thus holding the sound tube 3 in position with respect to the ear. The loop may be adjustable to the size and shape of the ear of the wearer, by means of a series of notches 6. The sound tube 3 including the coupling means 4 and the loop 5 is usually supplied as an assembled, replaceable unit.

At the end of the sound tube 3 an earplug 7 according to the invention is attached. The earplug 7 is typically a separate part, which can be replaced independently of the sound tube 3. This is because the earplug 7 is generally more prone to being soiled, e.g. by cerumen, than the sound tube 3, and thus needs more frequent replacement. The earplug 7 is made from a softer material than the tube 3, preferably by injection molding, whereas the tube 3 is supplied in lengths of extruded material. The tube 3 itself is made of a softer material than the shell of the housing of the hearing aid 1. The material of the earplug would preferably be a thermoplastic elastomer, TPE.

Figure 2:
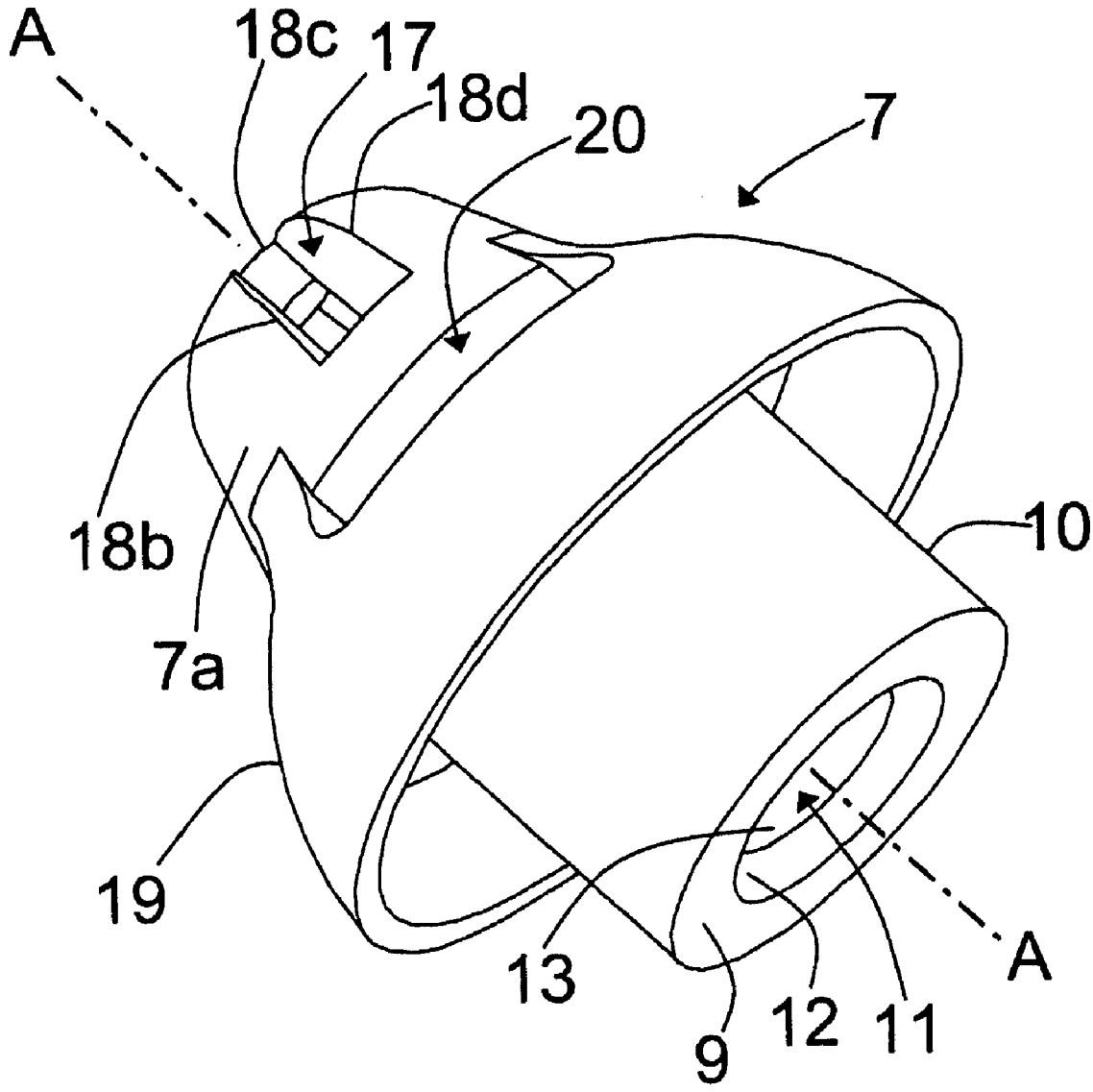
FIG. 2 is a perspective view of the earplug according to the first embodiment of the invention.
Figure 5:
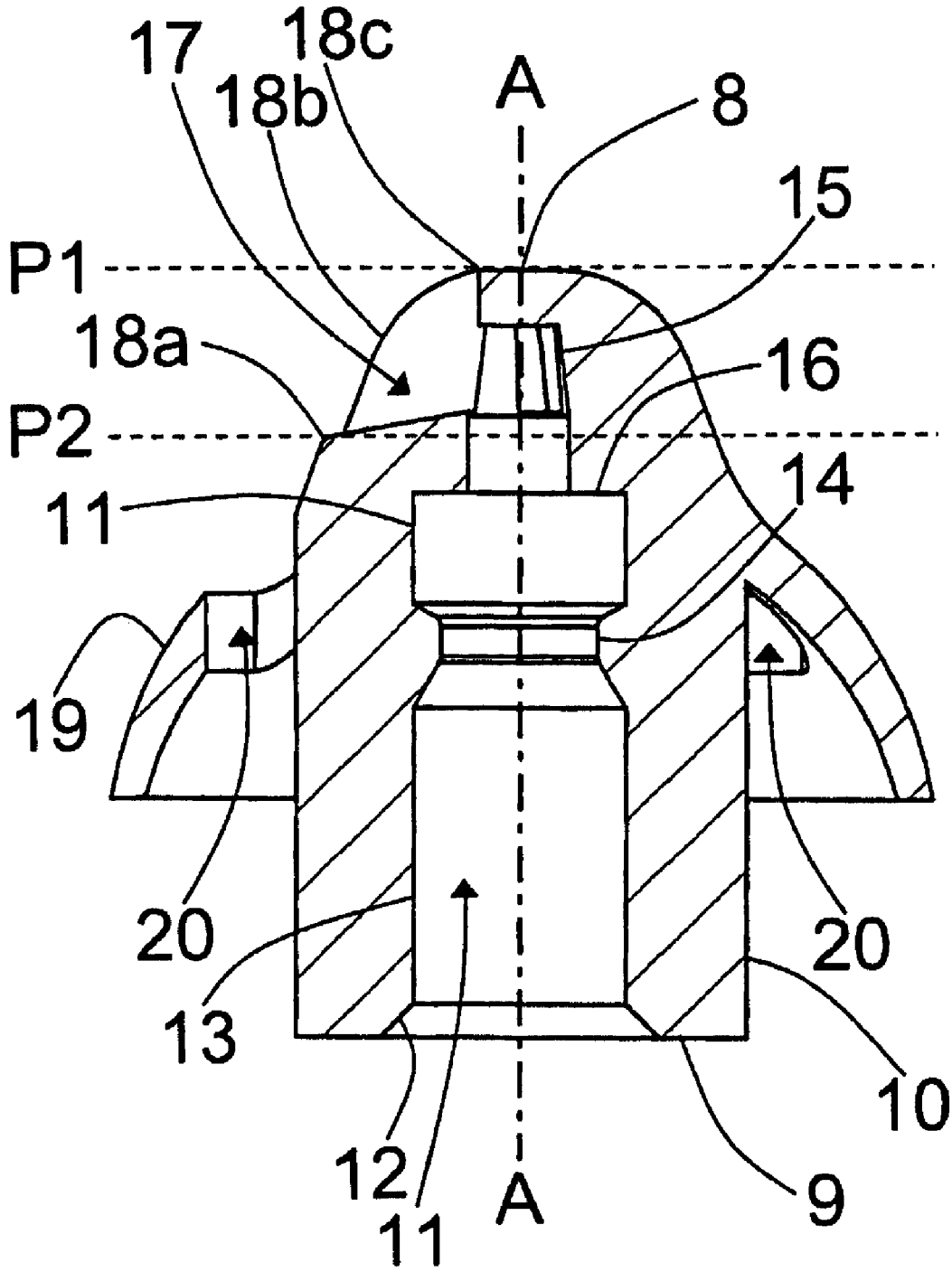
FIG. 5 is a cross sectional view of the earplug according to the first embodiment of the invention taken along the line V-V in FIG. 3.

The earplug 7 according to FIG. 1 is shown in greater detail in FIG. 2. As can be seen, the overall shape of the earplug 7 is a body of revolution about an axis A-A. The earplug 7 has a front end 8 (ref. FIG. 5) and a rear end 9. When the earplug 7 is inserted into the ear canal of a wearer, it is inserted with the front end 8 first. Also, the earplug 7 generally has rotational symmetry along the axis A-A, the order of which may vary along the axis A-A. This, however, is not an essential feature, and some of the cross sections along axis A-A may not have any rotational symmetry at all. In this case the axis A-A is rather to be understood as an axis along which the earplug 7 will preferably be inserted into an ear canal.

The earplug 7 comprises a generally cylindrical main body part 10. Since the earplug 7 is preferably a body of revolution, the main body part 10 is preferably a central part coaxial with the axis A-A. The cylindrical part 10 has a longitudinal bore, in which an end of the sound tube 3 is inserted. The longitudinal bore, in which the sound tube 3 is inserted, is preferably provided as a central bore 11 along the axis A-A. The central bore 11 has a first portion 13, which is adapted to the size of the sound tube 3 to be inserted therein. The first portion 13 of the central bore 11 is thus typically cylindrical. To facilitate the insertion of the sound tube the central bore may have a chamfer 12, in order to give the bore 11 increased dimensions at the rear end 9 of the earplug, where the sound tube 3 is to be inserted. In order to secure the sound tube 3 in the central bore 11, the central bore 11 may have locking means. As best seen in FIG. 5, this locking means may comprise a narrowed portion, formed by an annular rib 14. When the sound tube is inserted in the central bore 11, this rib 14 will engage the sound tube 3. Preferably, the sound tube 3 is provided with a matching circumferential groove (not shown). In order to prevent the sound tube 3 from being inserted too far into the central bore 11, the central bore 11 has a second narrower portion 15, forming a shoulder 16, which the sound tube 3 may abut when inserted into the central bore 11. Inserting the sound tube 3 too far could otherwise block the communication from the central bore 11 to the sound passages 17, which lead to sound output openings (generally designated by reference numeral 18) on the outer surface 7*a* of the earplug 7, because these passages 17 extend laterally in accordance with the general inventive concept of the invention.

Partially in order to ensure that the edges 18*a*, 18*b*, 18*c*, 18*d* of the sound output openings 18 do not engage the wall of the ear canal, the hearing aid has a collar 19, surrounding the main body part 10. If a sound output opening 18 engages the wall of the ear canal, it may pick up cerumen, which may block it, or it may be blocked simply by the engagement with the wall.

Figure 3:
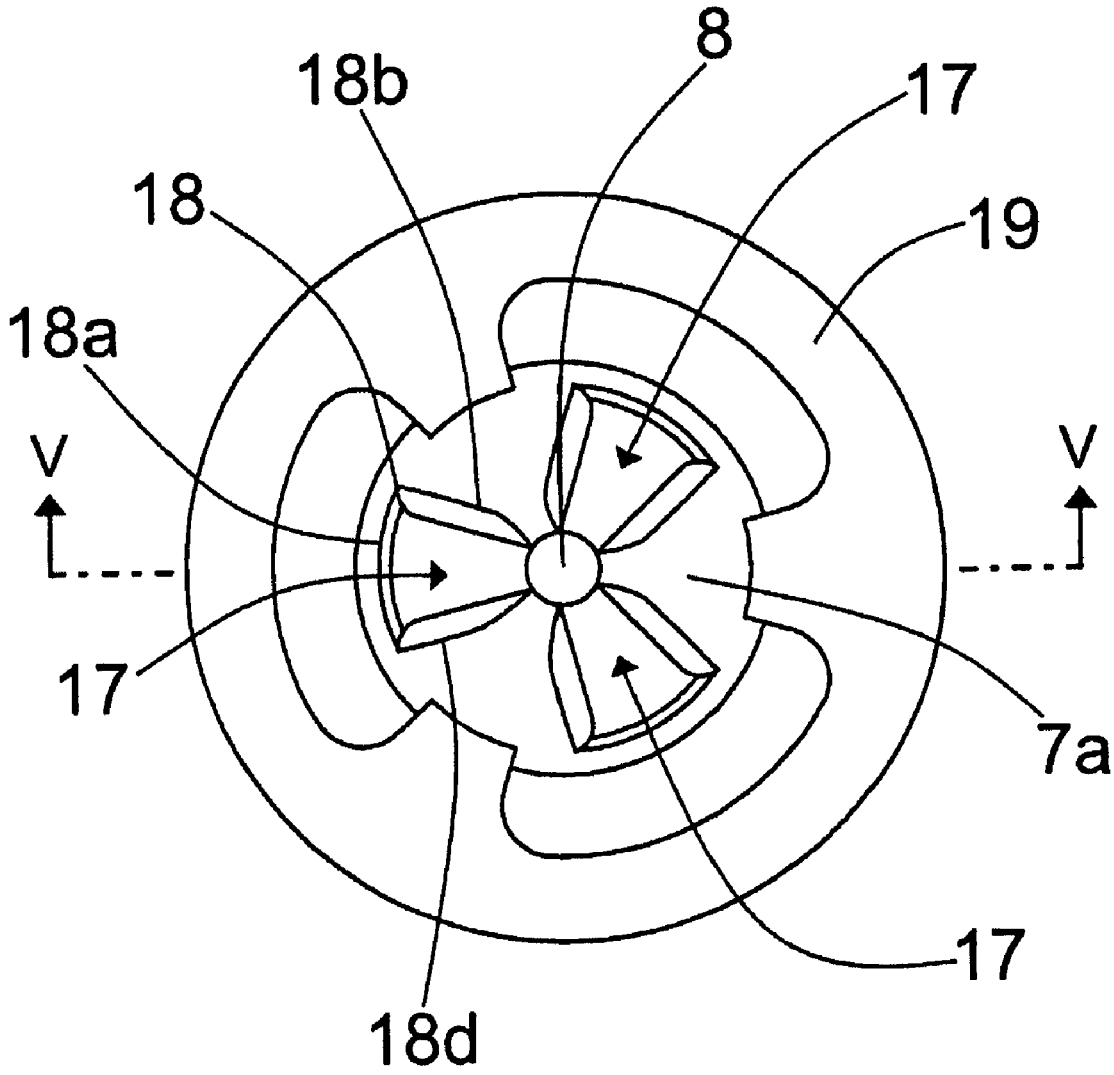
FIG. 3 is a front plan view of the earplug according to the first embodiment of the invention.
Figure 4:
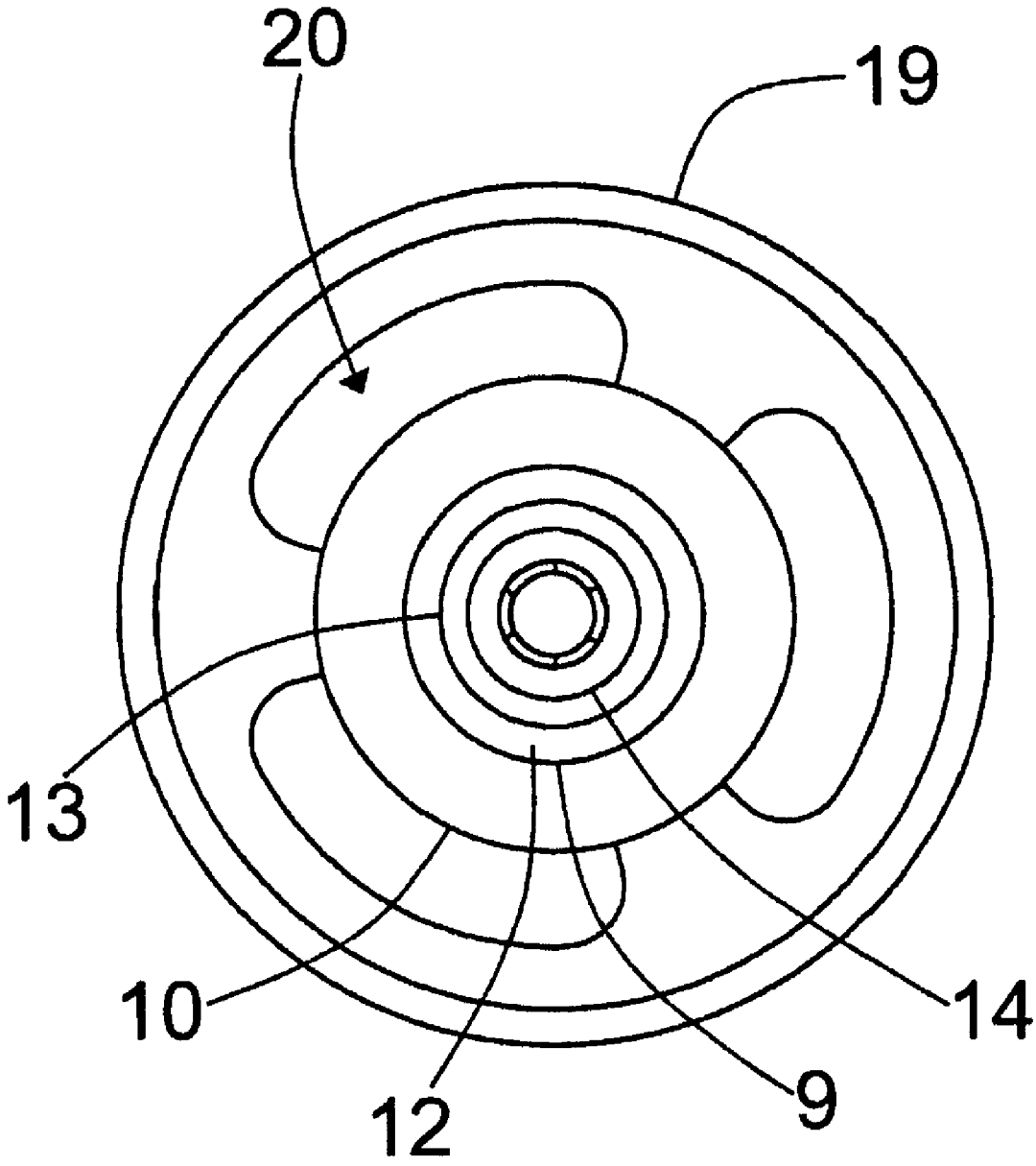
FIG. 4 is a rear plan view of the earplug according to the first embodiment of the invention.

As can best be seen from FIG. 3, the earplug 7 has a plurality of sound passages 17, namely three equidistant sound passages 17, each of which extends in a generally lateral direction from the central bore 11. Having several sound passages 17 further reduces the risk of blockage. Given the matched dimensions of the ear canal and the earplug 7, it is substantially less likely that all should engage the wall of the ear canal at the same time or during the same insertion motion. Rather, if one sound output opening 18 of the earplug 7 is forced against the wall of the ear canal at one side, the other sound output openings 18 will be farther away from the wall of the ear canal on the other side, and thus less prone to blockage.

If only one sound output opening 18 is used, the main body part 10 may preferably not be central part, but off-set with respect to the center of the collar 19. This allows the collar 19 to aid in ensuring a larger distance from the wall of the ear canal to the sound output opening 18, than would be the case with a coaxial centrally arranged main body part 10.

In the embodiment described in FIGS. 1 to 5, the sound output openings in the surface 7*a* of the ear plug are defined by four edges 18*a*, 18*b*, 18*c*, 18*d*, one of which is retracted with respect to the front end 8 of the earplug 7, that is to say it does not lie in an imaginary plane P1 tangential to the very tip of the front end 8 of the earplug 7, or if the tip is a point, an imaginary plane P1 to which the axis A-A is a normal, in which plane said point is located. Rather, it is located in such a way that it lies in or intersects an imaginary plane P2, to which the axis A-A is a normal, located at a point between the front end 8 of the earplug and the rear end 9 thereof. Preferably, there is also a distance between the edge 18*a* and the central bore, e.g. in form of a passage 17. This prevents cerumen from entering directly into the central bore.

Figure 10:
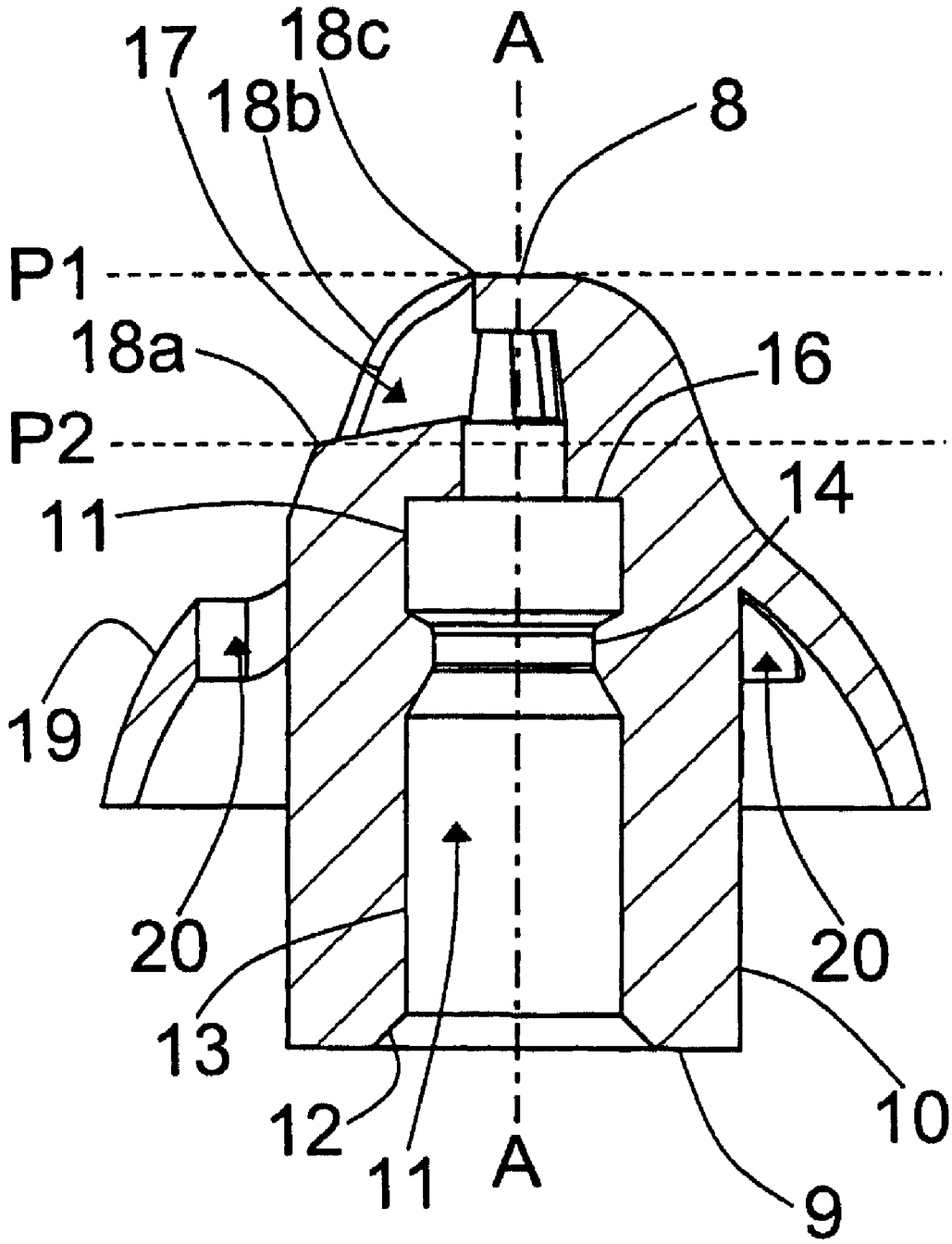
FIG. 10 is a cross sectional view of a modification of the hearing earplug in FIG. 5.

As can best be seen from FIG. 2, the passages 17 leading from the central bore 11 to the openings 18, are essentially shaped as slits. As also illustrated in FIG. 2, the slits may have a taper from the opening to the central bore, i.e. a wedge-shape. This allows the openings 18 to have larger dimensions than the cross-section or diameter of the central bore 11, which in turn reduces the risk of blockage. Moreover, the edges of the sound output openings need not be sharp but may be rounded such as illustrated by edge 18*b* in FIG. 10.

Apart from serving to position the main body part 10 of the earplug 7 properly with respect to the ear canal, the collar 19 also has vent openings 20 to allow sound to leave and enter the ear independent of the hearing aid 1. This overcomes the occlusion effect and allows persons with only mild hearing losses, e.g. only at certain frequencies, to hear sounds in their environment directly.

It should however be noted that the main purpose of the collar 19 is to secure the main body part 10 in the ear canal, while at the same time preferably also aiding in providing a well defined position of the main body part 10 therein. Moreover, it should be noted that the skilled person will understand that it not necessary that the collar has vent openings 20 at all. Not having vent openings 20 may be advantageous in the sense that it will reduce the risk of feedback from the sound output openings 18 to the input transducers of the hearing aid 1.

Figure 6:
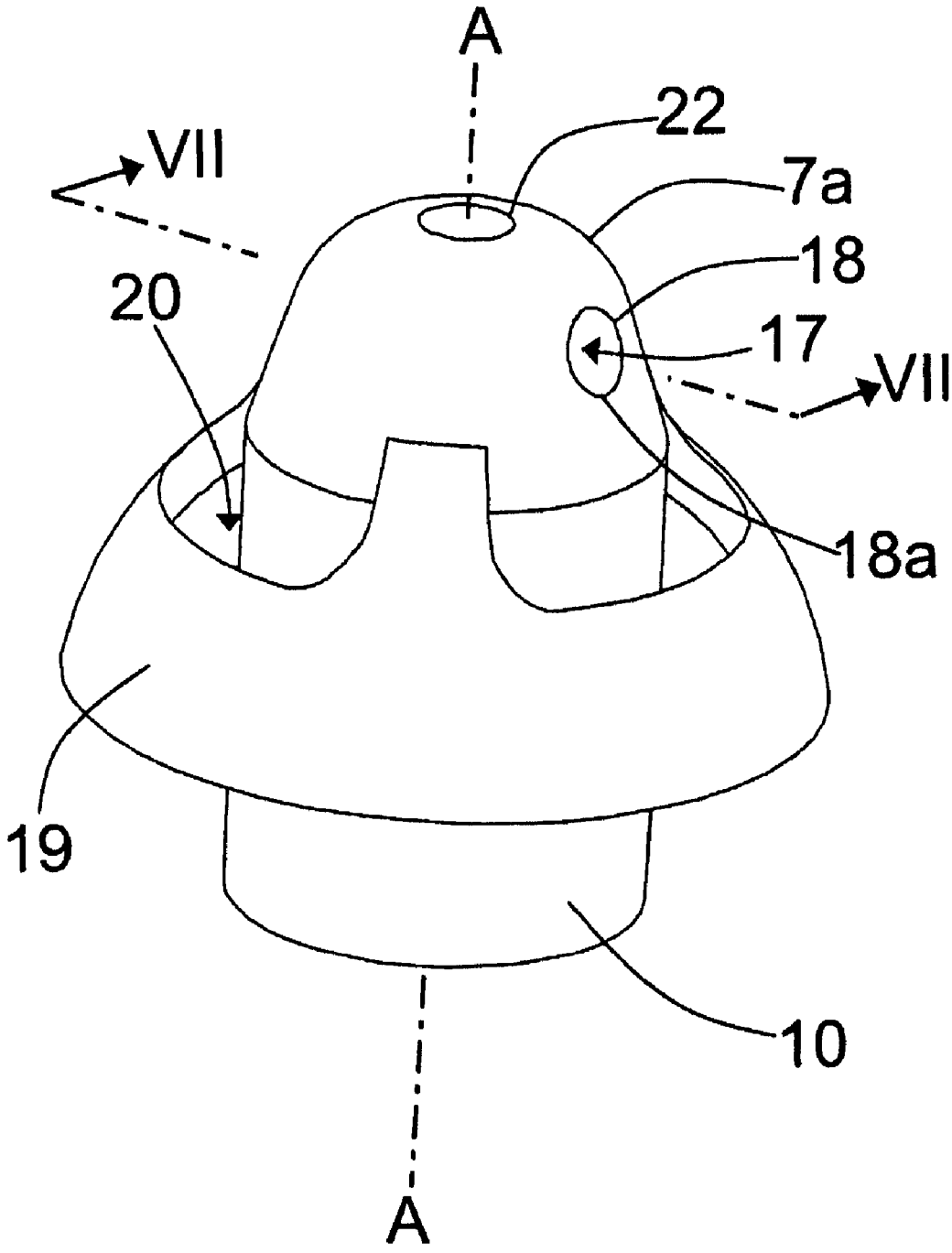
FIG. 6 is a perspective view of a second embodiment of the earplug according to the invention.
Figure 7:
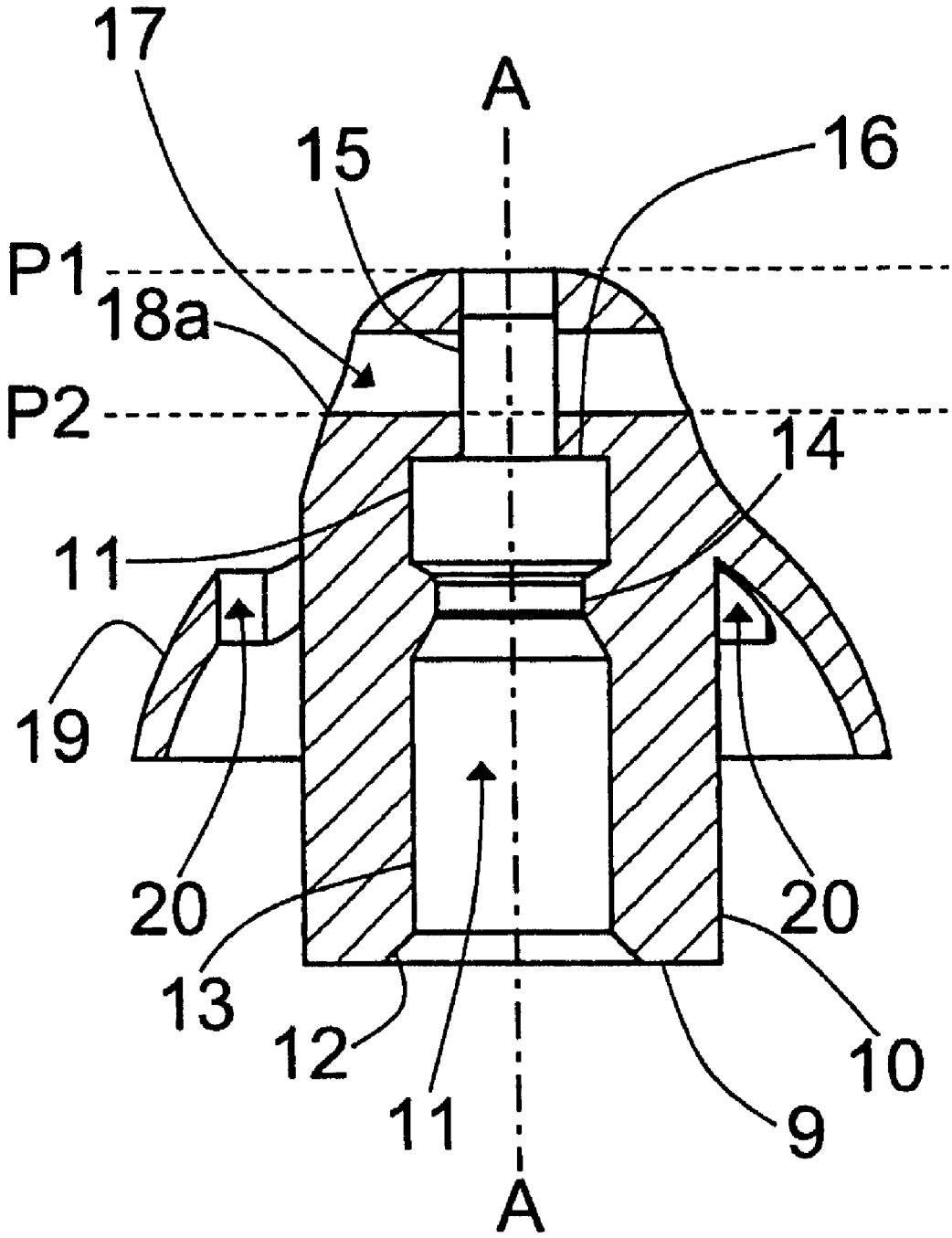
FIG. 7 is a cross sectional view of the second embodiment taken along the line VII-VII in FIG. 6.

FIGS. 6 and 7 illustrate a different embodiment of the earplug 7 according to the invention. Elements, which correspond to elements of the embodiment described above, will have the same reference numerals, and their description will only be repeated to the extent necessary for the understanding of this embodiment.

Unlike the embodiment above, which has three slit-shaped passages from the central bore 11 to the same number of sound output openings 18, the earplug of FIGS. 6 and 7 has two oval openings 18 in the surface 7*a*. In FIG. 7 it can be seen that this oval shape is a consequence of the passages 17 being cylindrical. Thus because of the complex curved shape of the outer surface 7*a*, the sound output opening becomes an oval in the broadest sense, i.e. not necessarily an ellipse. The passages 17 could evidently also have a taper towards the central bore, i.e. be frusto-conical. Having tapered passages 17 facilitates the removal of cores or form parts after the molding of the earplug.

In addition to the lateral sound passages 17, the earplug also has an axial sound passage 21 leading to a further opening 22. This additional sound passage is cylindrical and coaxial with the axis A-A. Even though this passage 21 is just as prone to being blocked by cerumen as coaxial passages in the prior art, this is not a problem because the lateral passages 17 and openings 18 will not be blocked. Evidently the passage 21 may also have a taper.

Figure 8:
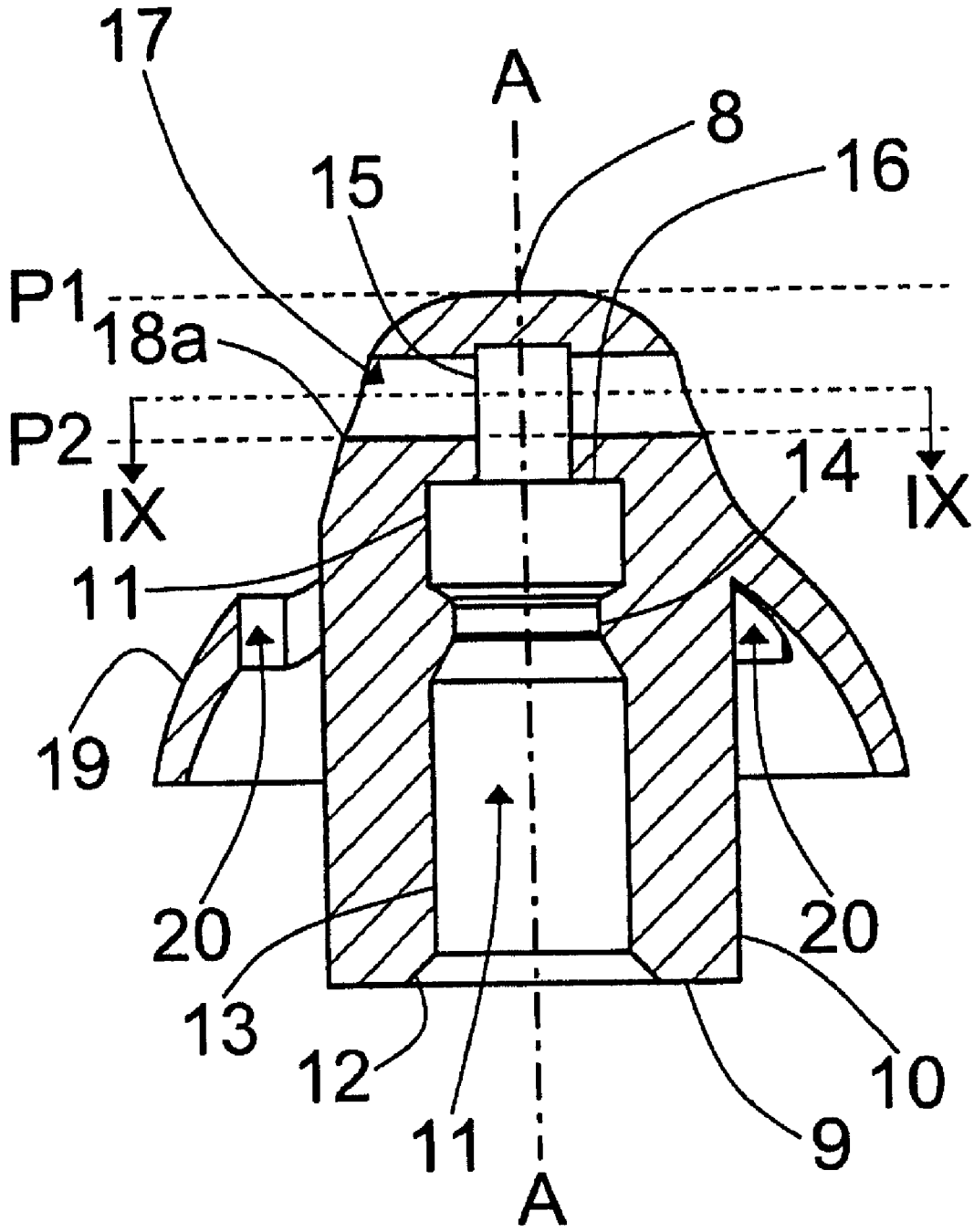
FIG. 8 is a cross sectional view corresponding to that of FIG. 7 of a third embodiment of the invention.

This additional passage is however optional, and FIG. 8 illustrates an embodiment corresponding to that of FIGS. 6 and 7, but without the axial sound passage.

Figure 9:
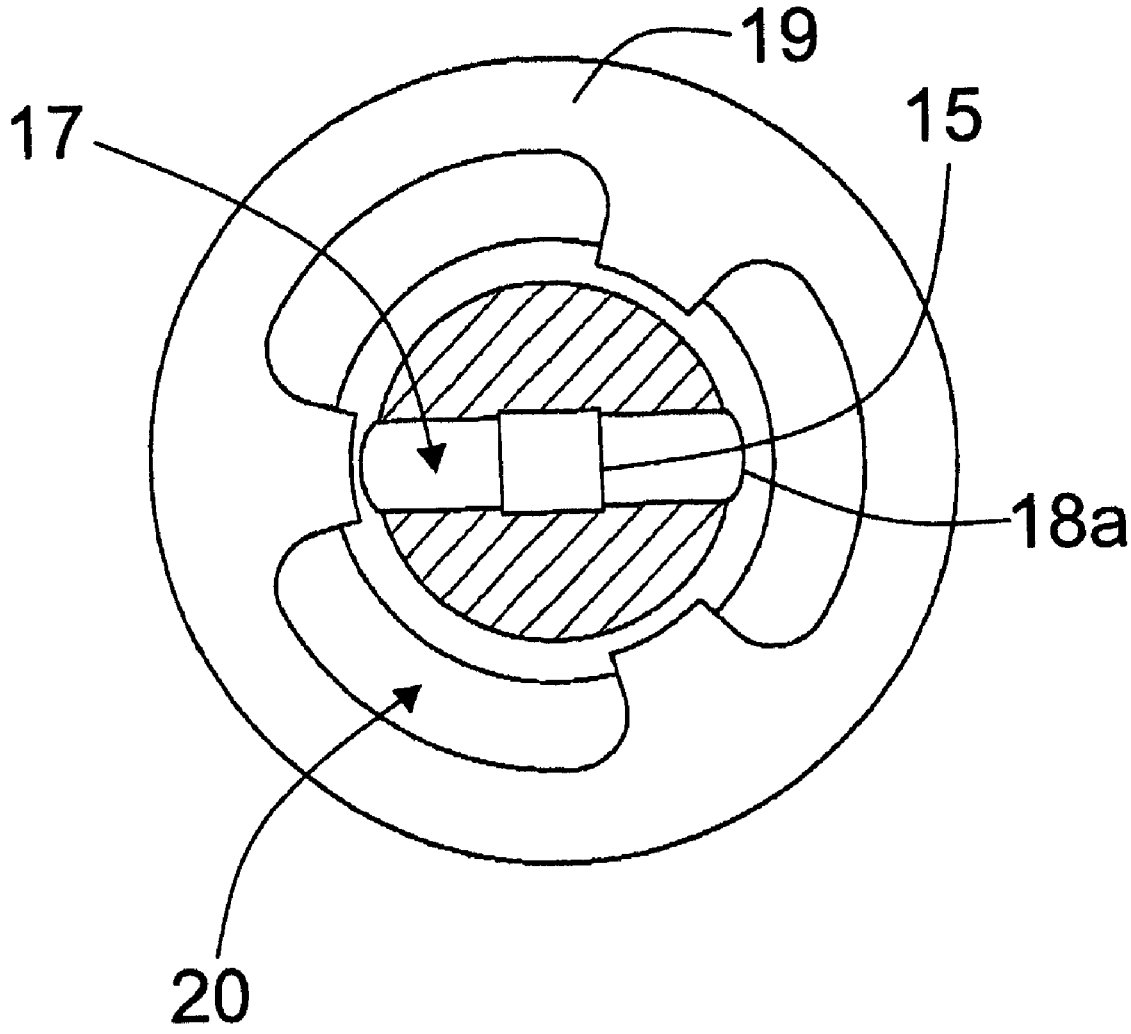
FIG. 9 is a cross sectional view of the third embodiment taken along the line IX-IX in FIG. 8.

Even though most of the central bore 11, and the sound passages preferably have circular cross-sections, it is advantageous if the central bore 11 has a junction part 23 with a polygonal cross-section where the sound passages 17 meet the central bore 11. This is best seen in FIG. 9, which is a cross section taken along the line IX-IX in FIG. 8. The embodiment in FIG. 7, however, has the same cross section and FIG. 9 could just as well be a cross section thereof. The number of sides of the polygonal cross-section should reflect the number of sound passages 17. In the example illustrated in FIGS. 7-9, the cross-section is square, because there are two sound passages 17. Having a square cross-section facilitates the molding because cores inserted laterally for forming the sound passages 17 can have plane end surfaces matching the plane sides of a core forming the junction part 23 of the central bore 11. Thus, a square cross section would also be appropriate if there were four bores, with a 90° spacing, whereas a triangular cross section would be appropriate for three passages with a 120° spacing.

As can clearly be seen from FIG. 7, the lower edge 18*a* of the opening 18 lies in the plane P2 retracted with respect to the plane P1 in which the tip 8 of the earplug 7 lies. In fact, all parts of the edge of the opening 18 in FIG. 7 lie retracted in this way, i.e. all edge parts of the sound output opening 18 are located in such a way that they lie in, or intersect, an imaginary plane, to which the axis A-A is a normal, located at a point between the front end 8 of the earplug and the rear end 9 thereof.

Evidently, the same is true for the embodiment shown in FIG. 8. Moreover, the skilled person will understand that if the edge 18*c* in FIG. 5 is placed farther away from the axis A-A back along the edge 18*b* away from the tip 8 towards the rear 9, the same will be true for this embodiment. Conversely the skilled person will understand that the sound slits forming the sound passages 17 could pass all the way across the front end of the main body part.

Also, the skilled person will know that features from the various embodiments described can be combined without deviation from the invention.

Finally it should be noted that the above embodiments are only examples, and that even though the earplug has been exemplified by means of a specific BTE type hearing aid, the skilled person will realize that the teaching regarding the earplug is also applicable to other types of hearing aids. In particular the earplug could accommodate the output transducer of the hearing aid, thus obviating the sound tube, which could then be replaced with an electrical or electromagnetic transmission means.

We claim:

1. An earplug for a hearing aid, comprising a front end, a main body part and a collar, wherein said front end is adapted to be inserted into an ear canal of a wearer, wherein said main body part has a bore, and a plurality of sound output passages with sound output openings in communication with said bore, arranged in a lateral way and distributed around the main body part, a first sound output passage having a first sound output opening, having at least one edge part located in a retracted manner with respect to said front end, and said first sound output passage having a taper towards the longitudinal bore, and wherein said collar surrounds said main body part and is adapted to engage a wall of the ear canal.

2. The earplug according to claim 1, wherein said first sound output passage has an edge part located in a retracted manner with respect to said front end.

3. The earplug according to claim 1, wherein said main body part comprises a second sound output passage leading to a second sound output opening.

4. The earplug according to claim 3, wherein said longitudinal bore defines an axis, and wherein said second sound output passage extends in a direction coaxially with said axis.

5. The earplug according to claim 1, wherein at least one sound output passage has a circular cross section.

6. The earplug according to claim 1, wherein the at least one sound output passage is shaped as a slit.

7. The earplug according to claim 1, wherein the longitudinal bore has means adapted for engaging a sound tube.

8. The earplug according to claim 1, wherein at least a part of said longitudinal bore has a polygonal cross section, in particular a square cross section.

9. The earplug according to claim 1 wherein said collar provides at least one vent passage.

10. A hearing aid, comprising an earplug, said earplug having a front end, a main body part and a collar, wherein said front end is adapted to be inserted into an ear canal of a wearer, wherein said main body part has a bore, a first sound output passage in communication with said bore and leading to a first sound output opening, said first sound output opening having at least one edge part located in a retracted manner with respect to said front end, and said first sound output passage having a taper towards the longitudinal bore, and said collar surrounds said main body part and is adapted to engage a wall of the ear canal.

11. The hearing aid according to claim 10, comprising a BTE housing.

12. The hearing aid according to claim 10, wherein said first sound output passage has an edge part located in a retracted manner with respect to said front end.

13. The hearing aid according to claim 10, wherein said main body part comprises a second sound output passage leading to a second sound output opening.

14. The hearing aid according to claim 13, wherein said longitudinal bore defines an axis, and wherein said second sound output passage extends in a direction coaxially with said axis.

15. The hearing aid according to claim 10, wherein at least one sound output passage has a circular cross section.

16. The hearing aid according to claim 10, wherein the at least one sound output passage is shaped as a slit.

17. The hearing aid according to claim 10, wherein the longitudinal bore has means adapted for engaging a sound tube.

18. The hearing aid according to claim 10, wherein at least a part of said longitudinal bore has a polygonal cross section, in particular a square cross section.

19. The hearing aid according to claim 10, wherein said collar provides at least one vent passage.

* * * * *